US010590739B2

(12) United States Patent
Cox et al.

(10) Patent No.: US 10,590,739 B2
(45) Date of Patent: Mar. 17, 2020

(54) METHOD AND APPARATUS FOR ACTUATION OF DOWNHOLE SLEEVES AND OTHER DEVICES

(71) Applicant: Map Oil Tools, Inc., New Iberia, LA (US)

(72) Inventors: Blake R. Cox, Houston, TX (US); Loren McNeely, Broussard, LA (US); Glen W. Holcomb, New Iberia, LA (US); Richard J. Morel, New Iberia, LA (US); Avel Z. Ortiz, Houston, TX (US); Joseph M. Montgomery, New Iberia, LA (US)

(73) Assignee: COMPLETION INNOVATIONS, LLC, New Iberia, LA (US)

( * ) Notice: Subject to any disclaimer, the term of this patent is extended or adjusted under 35 U.S.C. 154(b) by 34 days.

(21) Appl. No.: 15/983,411

(22) Filed: May 18, 2018

(65) Prior Publication Data

US 2018/0340396 A1 Nov. 29, 2018

Related U.S. Application Data

(63) Continuation of application No. 15/074,279, filed on Mar. 18, 2016, now Pat. No. 9,976,388, which is a (Continued)

(51) Int. Cl.
*E21B 34/14* (2006.01)
*E21B 34/12* (2006.01)

(Continued)

(52) U.S. Cl.
CPC ..... *E21B 34/12* (2013.01); *E21B 34/066* (2013.01); *E21B 34/14* (2013.01); *E21B 2034/005* (2013.01); *E21B 2034/007* (2013.01)

(58) Field of Classification Search
CPC ..... E21B 34/12; E21B 34/066; E21B 34/10; E21B 34/102; E21B 34/14; E21B 34/108
See application file for complete search history.

(56) References Cited

U.S. PATENT DOCUMENTS 8,403,068 B2 * 3/2013 Robison ..... E21B 23/006 166/194
8,910,716 B2 * 12/2014 Newton ..... E21B 43/12 166/373

(Continued)

*Primary Examiner* — Kenneth L Thompson
(74) *Attorney, Agent, or Firm* — Ted M. Anthony

(57) ABSTRACT

A downhole equalization assembly permits selective and remote opening of at least one downhole port or pathway to allow communication of pressure and/or fluid flow from inside a pressure containing system (such as, for example, a tubular pipe or other pressure containment system) to the outside of the containment system, or vice versa. A control device generating a magnetic field is inserted into a well and conveyed to a downhole equalization assembly. When the control device passes through an equalization assembly, an electronic counter is triggered. When a predetermined counter number is reached, a sliding sleeve is shifted, thereby exposing ports and/or pathways extending between the inside and outside of the equalization assembly. No physical contact or mechanical interference is required between the control device and any other components in order to actuate the equalization assembly.

14 Claims, 13 Drawing Sheets

Related U.S. Application Data continuation-in-part of application No. 14/206,403, filed on Mar. 12, 2014, now Pat. No. 9,410,401.

(60) Provisional application No. 61/778,896, filed on Mar. 13, 2013.

(51) Int. Cl.
*E21B 34/06* (2006.01)
*E21B 34/00* (2006.01)

(56) References Cited

U.S. PATENT DOCUMENTS

| | | | | |
|---|---|---|---|---|
| 9,410,401 | B2 * | 8/2016 | Cox | E21B 34/14 |
| 9,976,388 | B2 * | 5/2018 | Holcomb | E21B 34/12 |
| 10,273,780 | B2 * | 4/2019 | Garcia | E21B 23/01 |
| 2013/0264051 | A1 * | 10/2013 | Kyle | E21B 41/00 166/244.1 |
| 2015/0027724 | A1 * | 1/2015 | Symms | E21B 34/16 166/373 |

* cited by examiner

METHOD AND APPARATUS FOR ACTUATION OF DOWNHOLE SLEEVES AND OTHER DEVICES

CROSS REFERENCES TO RELATED APPLICATIONS

This Application is a continuation U.S. patent application Ser. No. 15/074,279, filed Mar. 18, 2016, now issued as U.S. Pat. No. 9,976,388, dated May 22, 2018, which is a continuation-in-part of U.S. Non-Provisional Patent Application Ser. No. 14/206,403, filed Mar. 12, 2014, issued as U.S. Pat. No. 9,410,401, dated Aug. 9, 2016, which claims priority of U.S. Provisional Patent Application Ser. No. 61/778,896, filed Mar. 13, 2013, all incorporated herein by reference.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to an assembly having flow ports that can be selectively actuated or opened by non-mechanical interference to permit communication of fluids and pressure between a first region and a second region. More particularly, the present invention pertains to a downhole sleeve assembly, beneficially includable within a tubular string or other tool assembly, having ports capable of being selectively opened to permit fluid pressure communication and fluid flow through said ports.

2. Brief Description of the Prior Art

From time to time it is advantageous, while controlling fluid flow and/or pressure in a system having an inside and an outside, to selectively open said system to allow fluid to flow and pressure to equalize between said inside and outside of said system. Although other applications can be envisioned, one such situation in which such selective opening is particularly beneficial is in connection with oil and/or gas wells and, more particularly, the stimulation, completion and production thereof.

Horizontal and/or non-vertical directional wells have become common, particularly as technology for drilling, completing and stimulating such wells in shale formations and/or other low permeability reservoirs has improved. However, even with advances in drilling technology, certain limitations exist that prevent optimization of the completion and stimulation of such horizontal and/or extended reach wells. Notably, although current drilling technology has increased the length that non-vertical or horizontal well sections can be drilled, such drilling technology has generally outpaced the ability to stimulate and produce oil and gas from such extended well sections.

One important factor that limits or restricts recovery from extended reach wells is the number of stimulation stages or points that can be effectively deployed in order to treat or stimulate all portions of such wells. Without a viable means of stimulating substantially the entire length of an extended well, the full potential of such deeper (or longer) wells cannot be realized. Put another way, the full benefits of extended reach wells are typically not realized if such wells cannot be stimulated along substantially their entire length.

Several methods are currently utilized to create an opening in wellbore tubular goods in order to equalize pressure and allow fluids to flow between the inside and the outside of said tubular goods. In most instances, said openings are designed to permit: (1) flow of stimulation (such as, for example, hydraulic fracturing) materials from the inside of wellbore tubular goods to reservoir(s) surrounding the outer surface of such tubular goods, and/or (2) production of fluids from such surrounding reservoir(s) into such wellbore tubular goods.

One existing method of creating such openings in wellbore tubular goods involves the use perforating guns which are lowered to a desired location within a well via wireline or tubing. Such perforating guns, which typically employ directional explosive charges, are remotely triggered in order to perforate the walls of such tubular goods. Unfortunately, there are practical limits to the depths/lengths within a wellbore at which such operations can be performed such as, for example, frictional limitations on the length of wireline or tubing that can be used to convey said perforating guns into a well.

Yet another conventional method of establishing communication between the inside and outside of wellbore tubular goods involves use of continuous or jointed tubing equipped with a specialized cutting device(s). Such a device is lowered into a well to a desired location and sand slurry or other abrasive fluid is pumped to the bottom of the continuous or jointed tubing; the abrasive fluid exits the device and erodes opening(s) in a surrounding wellbore tubular using the abrasive effect of such fluid. However, this method is also limited by the practical length that such continuous or other concentric tubing can be conveyed within a well, primarily due to wall frictional forces generated between such continuous/jointed tubing, and said surrounding wellbore tubular goods.

Another method commonly used for creating such downhole opening(s) in wellbore tubular goods involves the installation of at least one ported sliding sleeve and/or other similar apparatus at desired location(s) down hole (such as, for example, on or as part of a production casing string). When desired, such sleeve(s) can be selectively opened by mechanically manipulating the devices, typically using tools that are conveyed into a well via continuous tubing or wireline, thereby exposing such ports. However, use of such sliding sleeves or other similar devices also suffer from significant operational limitations. As with tubing perforation operations described above, frictional forces also limit the length of wireline or tubing that can be used for purposes of shifting or actuating such downhole sliding sleeves.

Certain other conventional downhole assemblies can be selectively opened using droppable or so-called "pump-down" objects such as, for example, balls or darts. Such conventional assemblies are typically operated by a sequence in which a small ball or dart is first dropped downhole. Said first ball or dart lands on a corresponding seat assembly, thereby blocking a fluid flow bore. Application of fluid pressure to said blocked bore facilitates actuation of said sleeve assembly. Thereafter, a slightly larger ball or dart can be dropped to land on a correspondingly sized seat in order to actuate a different sleeve assembly positioned further up hole.

This process can be repeated (generally moving from the deepest or furthest end of the well toward the surface) with each successive ball or dart having a larger outside diameter than the immediately preceding ball or dart. It is to be observed that the overall number of balls or darts that can be used in this manner is limited by the inside diameter of the surrounding tubular. As such, the total number of selectively actuated sliding sleeve assemblies that can be used is likewise limited.

Certain other devices utilize a consistently-sized droppable object (such as, for example, a plurality of balls all having a uniform outside diameter) to engage and operate a selectively actuated downhole apparatus. However, such devices generally require complex mechanical assemblies to operate. Use of such mechanical assemblies are particularly problematic during cementing and stimulation operations, because cement and stimulation proppant material (such as, for example, "frac sand" used in hydraulic fracturing operations) can invade such mechanical assemblies and negatively affect their operation.

The equalization assembly of the present invention overcomes the limitations of existing methods, permitting wells to be drilled with longer extended sections and to be optimally stimulated for greater production rates.

SUMMARY OF THE INVENTION

The present invention comprises a ported assembly that permits selective and remote opening of at least one downhole port or pathway to allow communication of pressure and/or fluid flow between the inside of a pressure containing system (such as, for example, a tubular pipe or other separate pressure containment system) and the outside of said containment system. Although other applications can be envisioned, the ported assembly of the present invention can be utilized in connection with oil and/or gas wells and, more particularly, the stimulation, completion and production thereof.

In a preferred embodiment, the present invention comprises a valve assembly, sometimes referred to herein as an "equalization assembly," that can be installed downhole at a desired location within a well bore. Although many different applications can be envisioned, the ported equalization assembly of the present invention can be installed on a production tubular (such as production casing or the like) within a vertical, directional or horizontal wellbore, and conveyed to a desired depth within said wellbore. Frequently, multiple equalization assemblies can be installed in sequence and spaced apart at desired intervals along the length of said wellbore. Further, said production tubular can be either cemented in place or left un-cemented, using packers or other sealing devices to isolate annular spaces between individual equalization assemblies.

Each equalization assembly has at least one transverse port or pathway extending from the inside to the outside of said assembly. When opened, said at least one port and/or pathway provides a flow path to permit fluid to flow and pressure to equalize between the inside and outside of said tubular. Moreover, when opened said port(s) and/or pathways provide a flow path for stimulation media such as fluids, gasses and proppants to be injected through said well bore and into the surrounding formation (typically during the completion phase of the well), while also providing a flow path for fluids from such formation(s) into the inside of the tubular (typically during the production phase of the well).

In a preferred embodiment, a control device (including, without limitation, a dart, ball, canister or threaded device) can be inserted into a well at the earth's surface and conveyed to said at least one downhole equalization assembly via various means (including, without limitation, via flowing fluid, wire line, continuous tubing and jointed pipe). Said control device contains at least one magnet or other device generating a desired magnetic field, and may optionally contain batteries or other power source(s).

The equalization assembly of the present invention further comprises a pressure balanced sliding sleeve. An incompressible fluid holds said sliding sleeve in a closed and locked position; in the closed position, said sliding sleeve blocks said transverse port(s) of the assembly.

Each equalization assembly(s) can be beneficially preset with a desired counter number. When a desired count is reached, the sliding sleeve becomes unbalanced. The internal pressure inside the tubular causes the now unbalanced sliding sleeve to shift, thus exposing ports and/or pathways extending between the inside and outside of the tubular through the equalization assembly(s). In one configuration an internal valve can then close to prevent fluid from flowing past the selected equalization assembly(s). In a second configuration the sliding sleeve can slide open without an internal valve closing allowing fluid to flow past the open assembly.

With the desired port(s) and/or pathways open, proppant and/or stimulation media can be pumped through the inner bore of the tubular goods, out the exposed port(s) or pathway(s) of the equalization assembly(s), and into the area surrounding said equalization assembly(s). Said open port(s)/pathway(s) also allow production fluids (for example, oil and/or gas) to flow from a surrounding reservoir into the inner bore of said tubular during a production phase for eventual recovery from said well.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
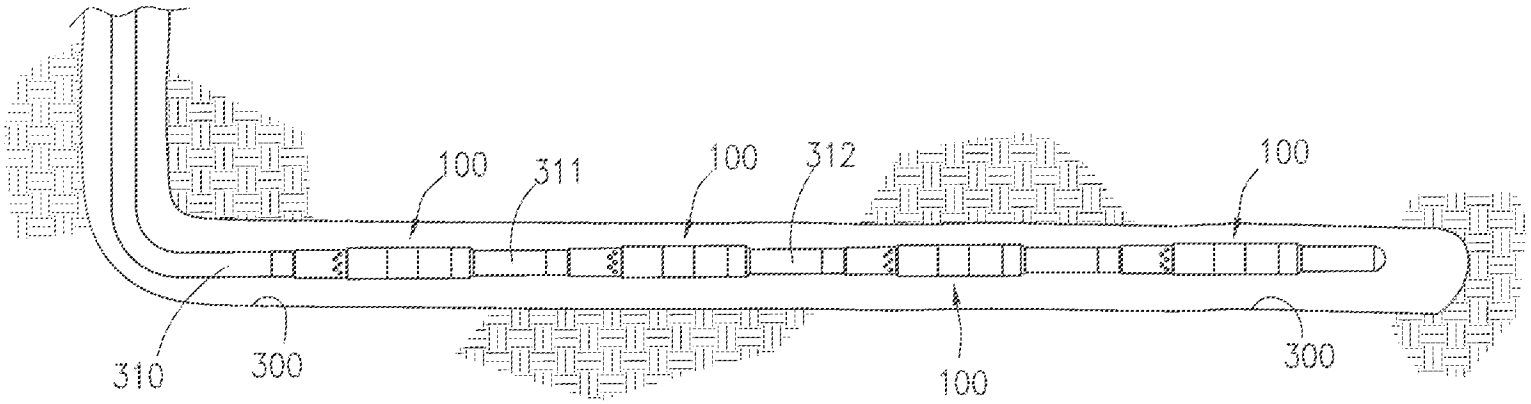
FIG. 1 depicts a side view of multiple equalization assemblies of the present invention deployed within a well bore.

Referring to the drawings, FIG. 1 depicts a side view of multiple equalization assemblies 100 of the present invention deployed in sequence within in a well bore 300. Although other applications can be envisioned without departing from the scope of the present invention, in a preferred embodiment said equalization assemblies 100 depicted in FIG. 1 are used in connection with the stimulation and subsequent producing phase of wellbore 300 drilled for the purpose of producing hydrocarbons from surrounding subterranean formation(s). Wellbore 300 is depicted in FIG. 1 as a substantially deviated well having an extended horizontal portion; however, it is to be observed that equalization assembly 100 of the present invention can likewise be used in vertical or non-horizontal directional wellbores.

After a well (such as wellbore 300) is drilled to a desired measured depth, pipe or other tubular goods are installed and cemented within said well. Thereafter, openings or flow ports in wellbore tubular goods must be provided in order to equalize fluid pressure and allow fluids to flow between the inner flow bore and the outside of said tubular goods (and vice versa). Said openings can beneficially permit flow of stimulation (such as, for example, hydraulic fracturing) materials from the inside of wellbore tubular goods into reservoir(s) surrounding the outer surface of such tubular goods. Said openings can also permit inflow of fluids from such surrounding reservoir(s) into said wellbore tubular goods such as, for example, during a production phase. Thus, equalization assembly 100 generally comprises an assembly having flow ports that can be selectively actuated via non-mechanical interference in order to allow communication of fluids and pressure between a first region and a second region.

As depicted in FIG. 1, in a preferred embodiment multiple equalization assemblies 100 are threadably connected within a tubular string 310 in spaced-apart relationship and conveyed via said tubular string 310; each of said equalization assemblies 100 are conveyed to a predetermined desired position within in wellbore 300. After being properly positioned within wellbore 300, tubular string 310 can then be cemented in place or left un-cemented, depending upon design parameters of said well and associated operations. Equalization assemblies 100 can be configured in series with said assemblies being preset to actuate individually, all together, or in distinct groups of two or more.

Figure 2:
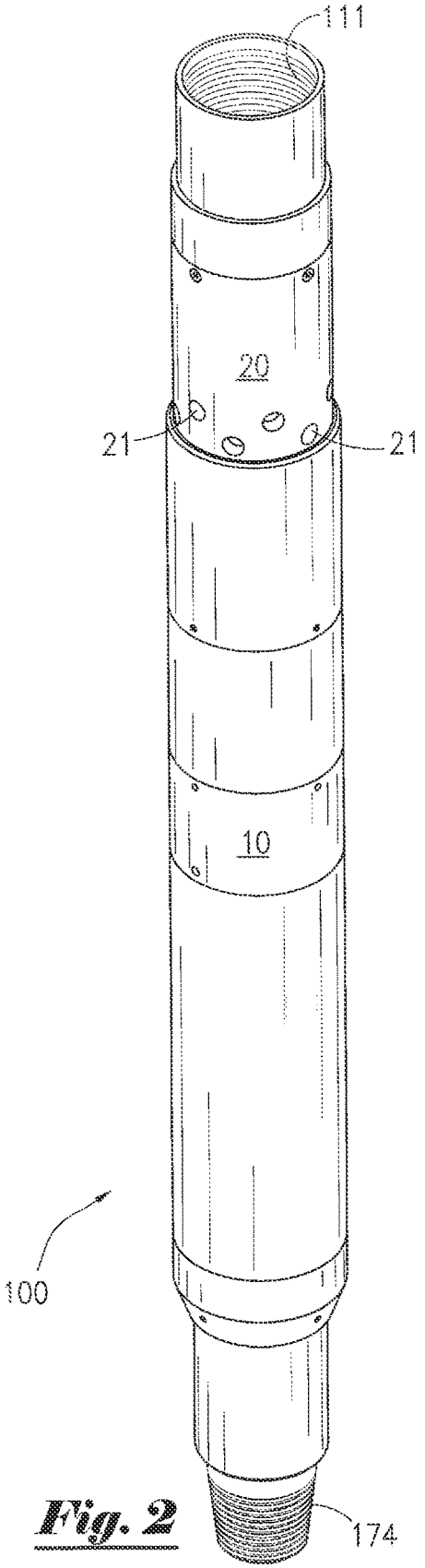
FIG. 2 depicts a side perspective view of an equalization assembly of the present invention.
Figure 3:
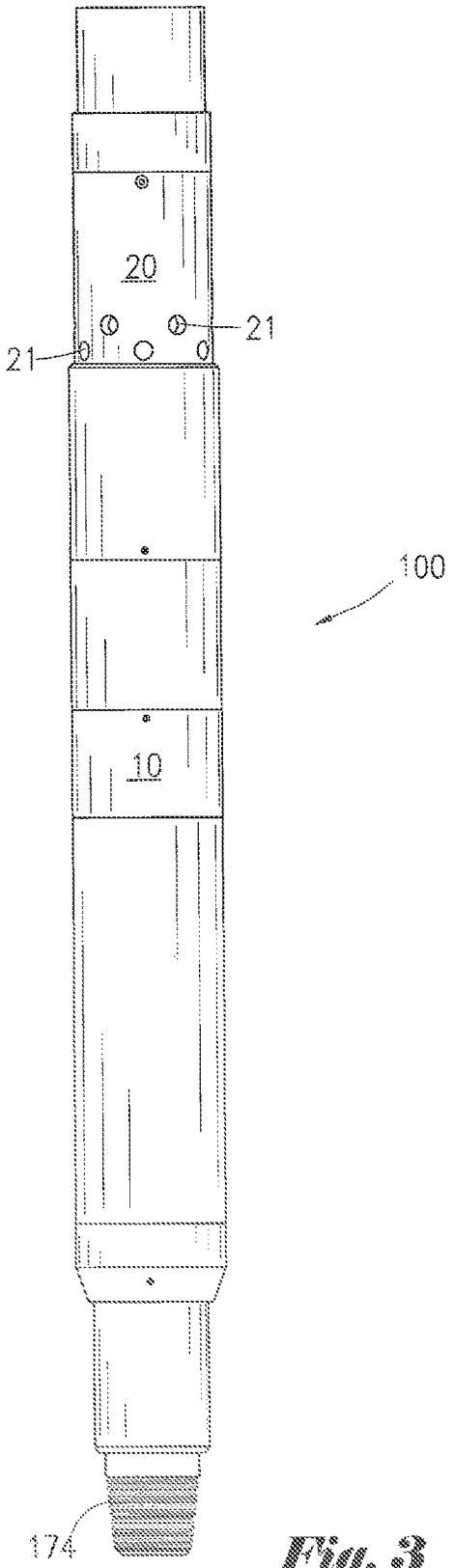
FIG. 3 depicts a side view of an equalization assembly of the present invention.

FIG. 2 depicts a side perspective view of an equalization assembly 100 of the present invention, while FIG. 3 depicts a side view of an equalization assembly 100 of the present invention. In a preferred embodiment, equalization assembly 100 can be threadably connected at a first end to a tubular member using upper (female) box-end threaded connection member 111. Similarly, equalization assembly 100 can be threadably connected at a second end to a tubular member using lower (male) threaded pin-end connection member 174. Referring back to FIG. 1, tubular members 311 and 312, which comprise components of tubular string 310, each have a central through-bore which defines an internal passage through said tubular members 311 and 312.

Referring to FIGS. 2 and 3, equalization assembly 100 generally comprises an actuation sub-assembly 10 and valve sub-assembly 20 described in more detail herein. A plurality of transverse equalization ports 21 extend through said valve sub-assembly 20, as described in greater detail herein. Said equalization ports 21 can be equipped with optional threaded or pressed nozzles that can limit the flow of fluids that can pass through said equalization ports 21, either initially or permanently.

In accordance with common oilfield practice, box-end threaded connection member 111 is positioned at the upper end of equalization assembly 100, while said pin-end threaded connection member 174 is positioned at the lower end of said equalization assembly 100. However, the configurations of said threaded connections 111 and 174 can be reversed or altered without departing from the scope of the present invention.

Figure 4:
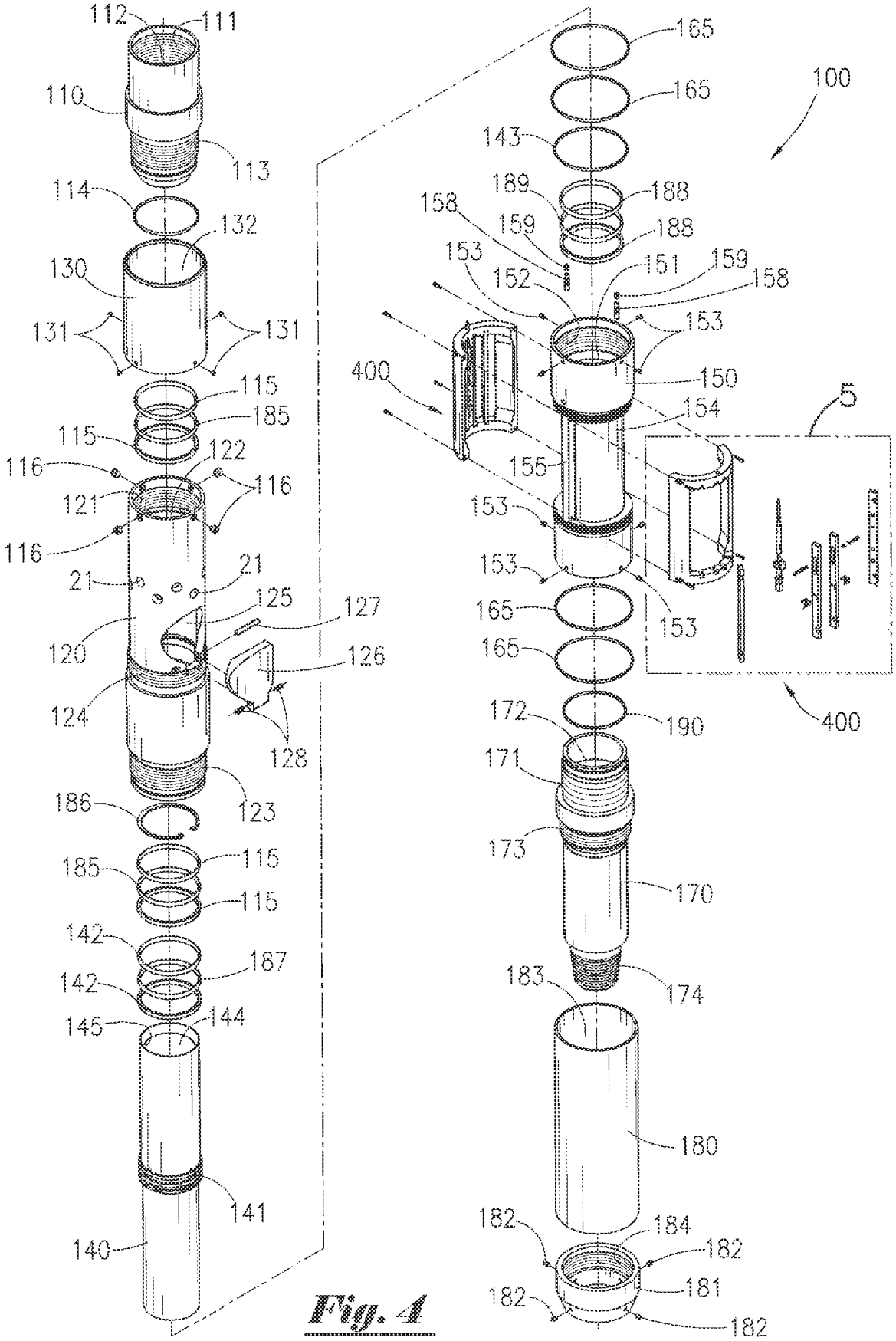
FIG. 4 depicts a perspective exploded view of an equalization assembly of the present invention.

FIG. 4 depicts a perspective exploded view of equalization assembly 100 of the present invention. In a preferred embodiment, equalization assembly 100 can be threadably connected at one end to a tubular member (such as, for example, tubular member 311 depicted in FIG. 1) or portion of a bottom hole assembly using cross-over member 110. Said cross-over member 110 has upper threaded female box-end connection member 111, central through bore 112 extending through said upper cross-over member 110, and lower threads 113.

Valve body member 120 has upper threaded connection member 121, central through bore 122 extending through said valve body member 120 and lower threaded connection member 123. In a preferred embodiment, a plurality of transverse bores or equalization ports 21 extend through said valve body member 120 to central through bore 122. Equalization ports 21 can be equipped with optional threaded or pressed nozzles that can limit the flow of liquids and gases that can pass through said equalization ports 21, either initially or permanently. External threads 124 are disposed along the outer surface of said valve body member 120.

An aperture or opening 125 extends through a side of said valve body member 120. A curved flapper member 126 is pivotally disposed within said opening 125 using flapper pivot pin 127; said flapper member 126 can pivotally move about said pivot pin 127 between a first open position wherein said flapper member 126 is substantially aligned with valve body member 120 within opening 125, and a second closed position wherein said flapper is oriented substantially perpendicular to the longitudinal axis of said central through bore 122. In said first open position, said flapper member 126 does not extend into central bore 122. In said second closed position, flapper member 126 substantially obstructs and prevents fluid flow through said central through bore 122. Springs 128 bias said flapper in said second closed position.

Outer housing sleeve 130 is partially received over valve body member 120 and secured to said valve body member 120 using external threads 124 and set screws 131. Threaded connection 113 of upper cross over member 110 is joined in mating relationship to inner upper threads 121 of valve body member 120. Elastomeric or rubber O-ring 114 provides a fluid pressure seal between said upper cross over member 110 and valve body member 120.

Inner sleeve member 140 has a central through-bore 144 defining an inner surface 145 and outer grooves 141 for receiving elastomeric or rubber O-rings 187 and seal rings 142 around the outer circumference of said sleeve member 140. A portion of said sleeve member 140 is slidably disposed within central through-bore 122 of valve body member 120. Elastomeric or rubber O-rings 185 and seal rings 115 provide a fluid pressure seal between inner sleeve member 140, valve body member 120 and the equalization ports 21. Elastomeric or rubber O-rings 189 and seal rings 188 also provide a fluid pressure seal between inner sleeve member 140 and actuator sub body member 150.

Equalization assembly 100 further comprises actuation sub body member 150 having upper threaded connection member 152 and a central through-bore 151 extending through said actuator sub body member 150. A portion of sleeve member 140 partially extends into said through-bore 153. Lower threaded connection 123 is joined with upper threaded connection 152 of actuation sub body member 150 and further secured together using set screws 153; elastomeric or rubber O-rings 143 provide a fluid pressure seal between said components.

Actuation sub body member 150 includes central recessed sections 154 divided by lateral wing flange members 155. In a preferred embodiment, said actuation sub body member 150 includes two lateral wing flange members 155 spaced approximately 180 degrees apart around the outer circumference of said sub body member 150. In this configuration, said lateral wing flange members 155 are aligned within the same plane.

Retention cage members 160 are aligned with said recessed sections 154 and secured in place against lateral wing flange members 155 using threaded bolts 164 or other effective fastening means. Each of said retention cage members 160 has a central window-like opening 161. Slotted notches 162 are disposed at desired locations around said opening 161. A valve stem aperture 163 extends through the upper portion of each retention cage member 160. Valve seat inserts 158 are aligned with said valve stem apertures 163. Elastomeric or rubber O-rings 159 provide a fluid pressure seal between seat insert 158 and actuation sub body member 150. Seat insert 158 is secured in place when valve body member 120 is joined with actuation sub body member 150.

Linear actuator assembly 200 is attached to actuator support braces 220, and can be secured using screws or other fastening means. In a preferred embodiment, said actuator support braces 220 are disposed in substantially parallel orientation and are received within the aligned slotted notches 162 in retention cage members 160. Additionally, housing sleeve support members 230 can also be received in said notches.

Equalization assembly 100 further comprises lower cross-over member 170 having upper threaded connection member 171 and a central through-bore 172 extending through said sub body member 170. Upper threaded connection member 171 is joined in mating relationship with an internal threaded connection in bore 151 of actuation sub body member 150 and further secured together using set screws 153; elastomeric or rubber O-rings 190 provide a fluid pressure seal between said components.

Outer housing sleeve 180 has central through bore 183 and is partially received over actuation body member 150 and lower cross over member 170. Elastomeric or rubber O-rings 165 provide a fluid pressure seal between outer housing sleeve 180 and actuation sub body member 150. Retention collar 181 having inner connection threads 184 is disposed over the lower portion of lower cross over member 170 and holds said outer housing sleeve 180 in place; said retention collar 181 is joined in mating relationship with external threads 173 of lower cross over member 170 and secured in place with set screws 182.

Figure 5:
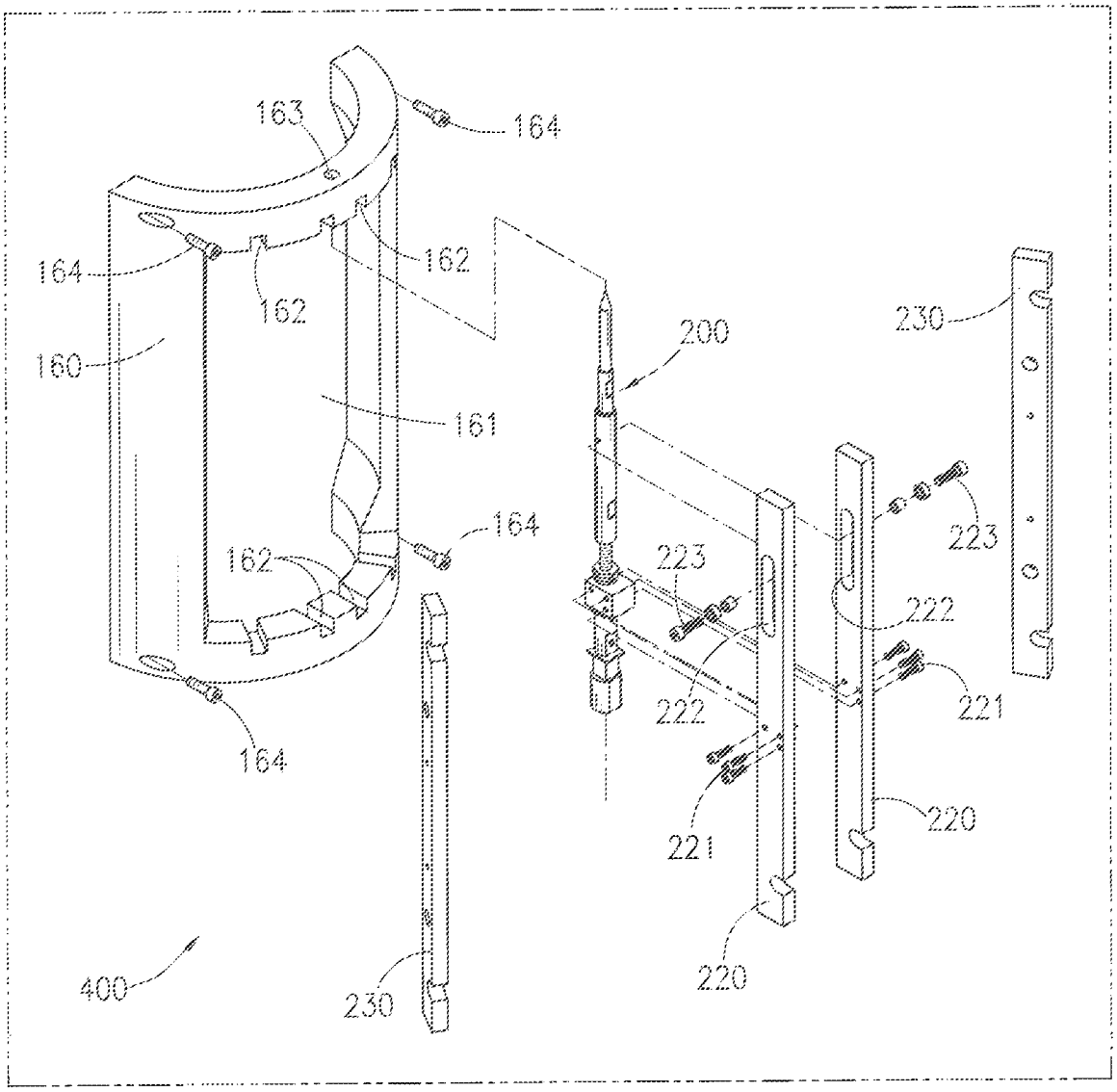
FIG. 5 depicts a detailed view of the area highlighted in FIG. 4.

FIG. 5 depicts a detailed view of the area highlighted in FIG. 4. Retention cage member 160 has a central window-like opening 161 and can be attached to actuation body member 150 (not shown in FIG. 5) using fasteners 164. Slotted notches 162 are positioned at desired locations around said opening 161; as depicted in FIG. 5, said notches are disposed in spaced relationship along the upper and lower edges of opening 161. A valve stem aperture 163 extends through the upper cross member of retention cage member 160.

Linear actuator assembly 200 is attached to actuator support braces 220, and can be secured to said braces 220 using screws 221 or other fastening means. In a preferred embodiment, said actuator support braces 220 are disposed in substantially parallel orientation and are received within the aligned slotted notches 162 in retention cage member 160. Additionally, housing sleeve support members 230 can also be received in said notches 162 and provide internal support for outer housing sleeve member 180 depicted in FIG. 4.

Figure 6:
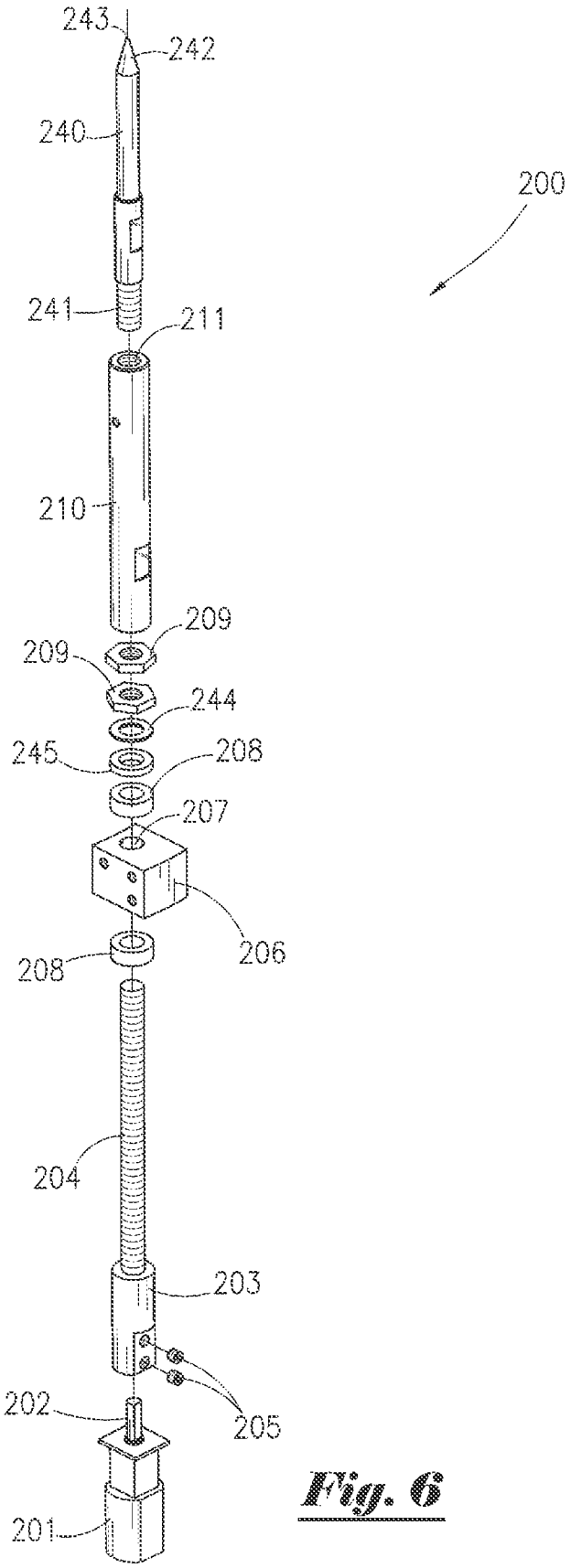
FIG. 6 depicts a perspective exploded view of an actuator of the present invention.

FIG. 6 depicts a perspective exploded view of linear actuator assembly 200 of the present invention. Linear actuator assembly 200 comprises electric (typically battery) powered micro motor 201 having rotating drive shaft 202. A threaded rod member has base member 203 and cylindrical threaded section 204 (which can comprise, by way of illustration, 10-32 threaded rod). Base member 203 has a bore (not shown in FIG. 6) for receiving drive shaft 202, and can be securely attached to said shaft 202 using set screws 205. Actuation of micro motor 201 results in the transfer of rotational torque forces from drive shaft 202 to base member 203 and threaded section 204.

Bulk head 206 has central bore 207. Referring to FIG. 5, said bulk head 206 is anchored between actuator support braces 220 and secured from movement (both axial and rotational). Threaded section 204 is received within said central bore 207.

A slide block coupling 210 has a threaded longitudinal bore 211. Fittings 209, flat washer 244, thrust bearing 245 and washer bearings 208 are received over the distal end of said threaded section 204, which is threadably received within said threaded bore 211; threads on the external surface of rod 204 mate with and engage against opposing threads on the internal surface of bore 211.

Slide block coupling 210 will not rotate as threaded rod member 204 rotates. Referring back to FIG. 5, slide block coupling is prevented from rotating by transverse guide bars 223 that are disposed within elongate parallel slots 222 in actuator support braces 220. Such guide bars 223 and elongate slots cooperate to permit slide block coupling 210 to move only in an axial direction as said slide block coupling 210 is threaded on or off of threaded section 204.

A needle valve shaft member 240 has threaded section 241 at its proximate end, and tapered section 242 forming point 243 at its distal end. Threaded section 241 of needle valve shaft member 240 is received within threaded bore 211 of slide block coupling 210. Referring back to FIG. 4, each valve seat insert member 158 is positioned in axial alignment with, and that can receive the distal end of, needle valve shaft member 240. Each seat insert member 158 defines an inner offset angle profile that generally conforms to the shape of tapered section 242 of needle valve shaft member 240.

Figure 7A:
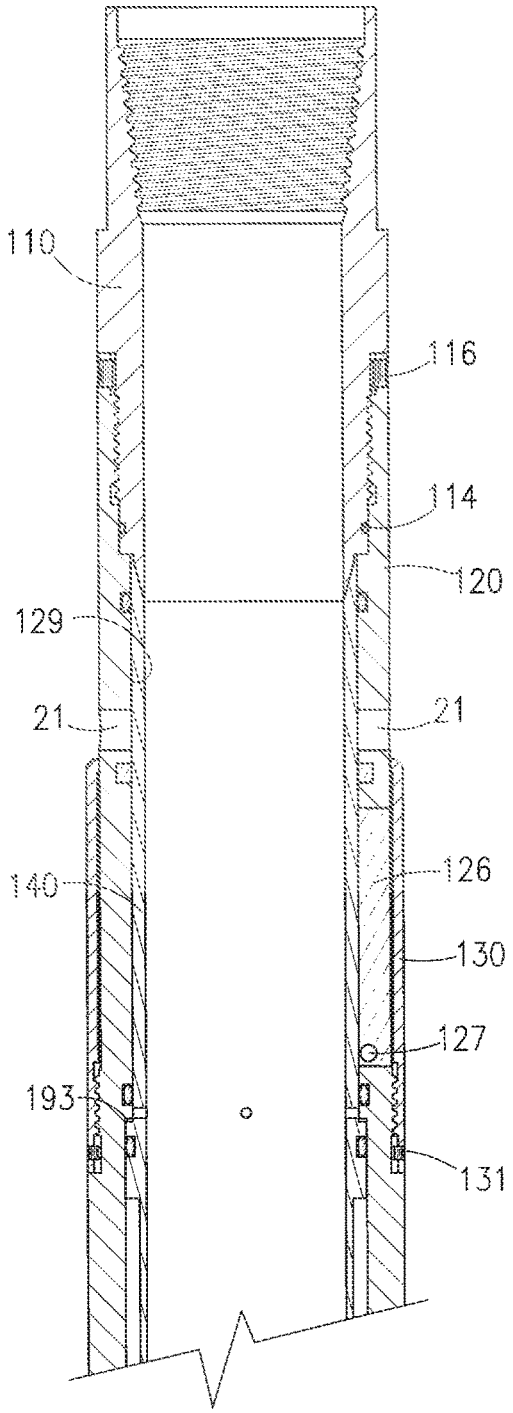
FIG. 7A depicts a side sectional view of a valve subassembly of an equalization assembly of the present invention.
Figure 7B:
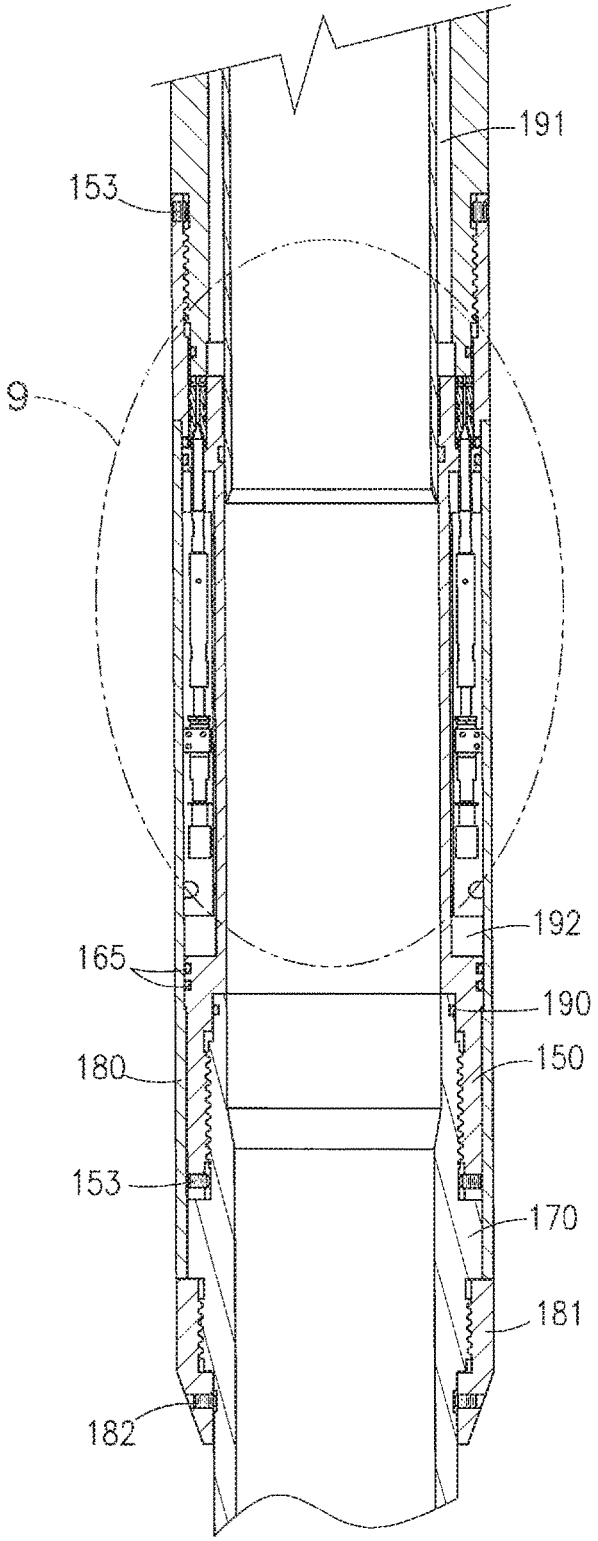
FIG. 7B depicts a side sectional view of an actuation sub-assembly of an equalization assembly of the present invention.
Figure 9:
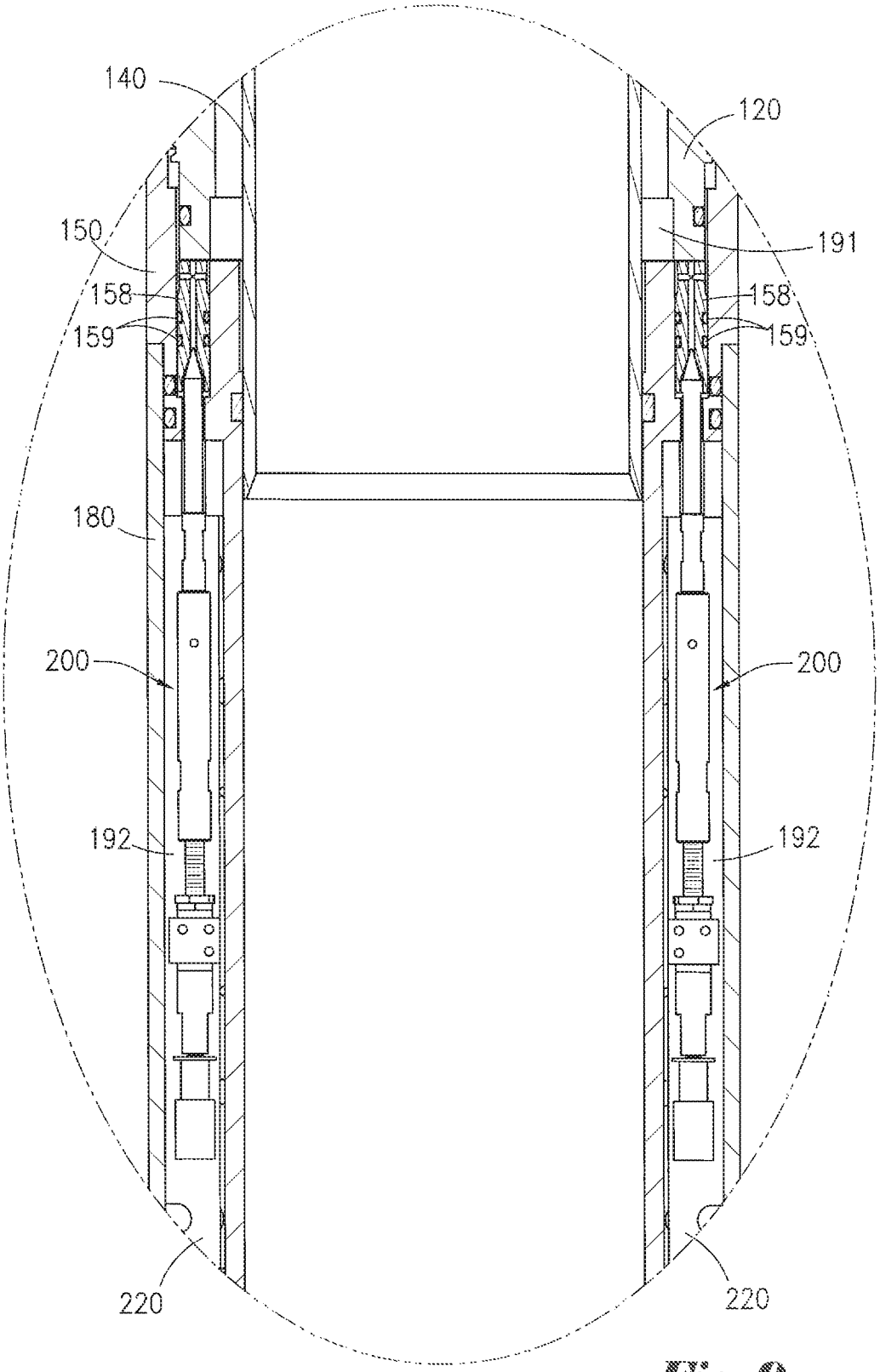
FIG. 9 depicts a detailed view of the area highlighted in FIG. 7B.

FIG. 7A depicts a side sectional view of a valve sub-assembly 20 of an equalization assembly 100 of the present invention in a closed position, while FIG. 7B depicts a side sectional view of an actuation sub-assembly 10 of an equalization assembly 100 of the present invention in a closed position. FIG. 9 depicts a detailed view of the area highlighted in FIG. 7B, generally corresponding to actuation sub-assembly 10.

Figure 8A:
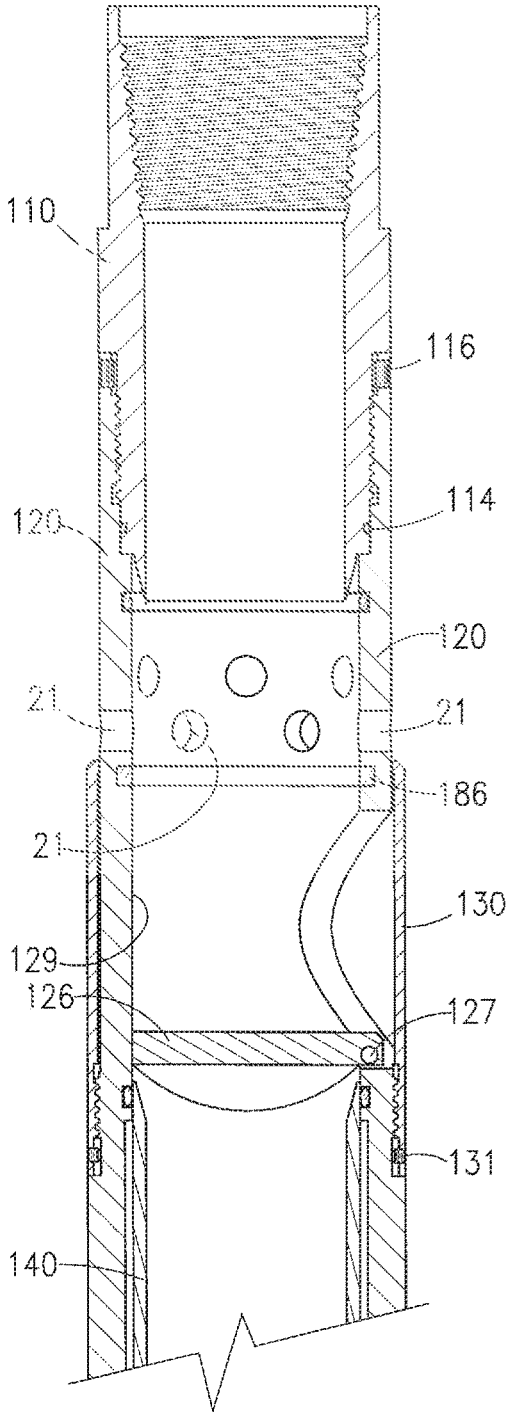
FIG. 8A depicts a side sectional view of a valve sub-assembly of an equalization assembly of the present invention.
Figure 8B:
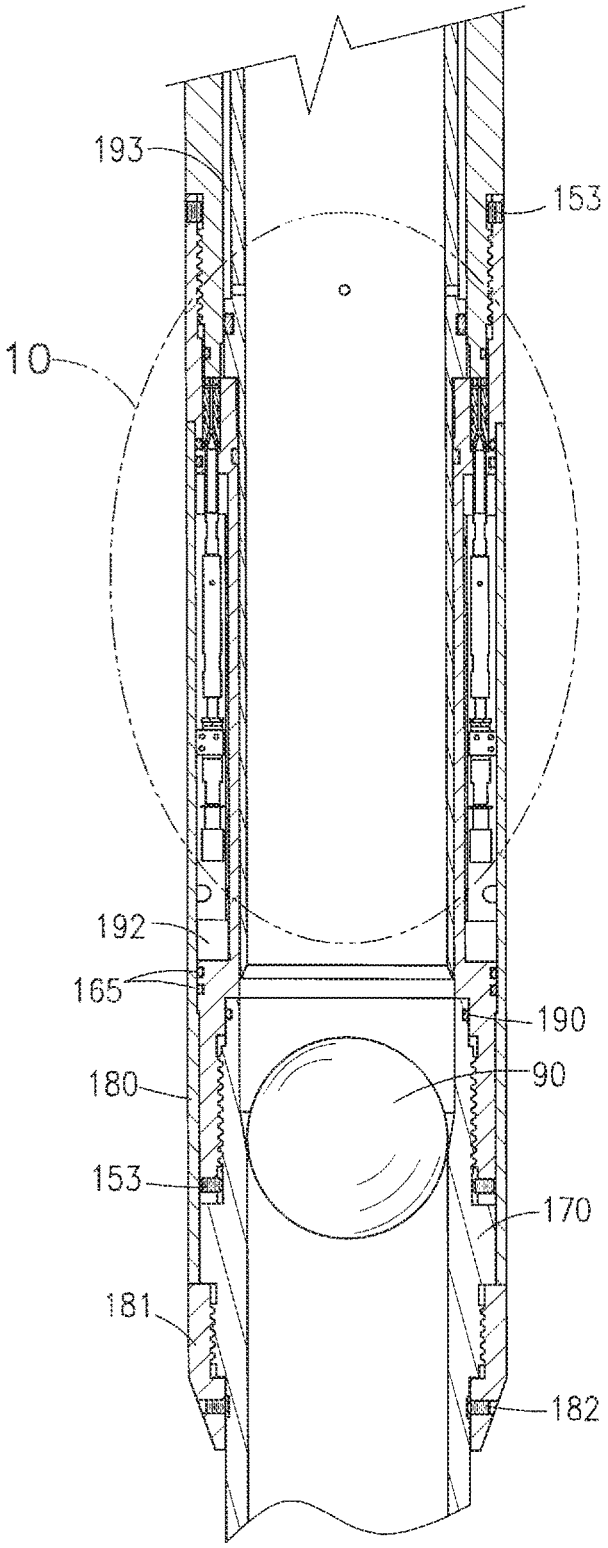
FIG. 8B depicts a side sectional view of an actuation sub-assembly of an equalization assembly of the present invention.
Figure 10:
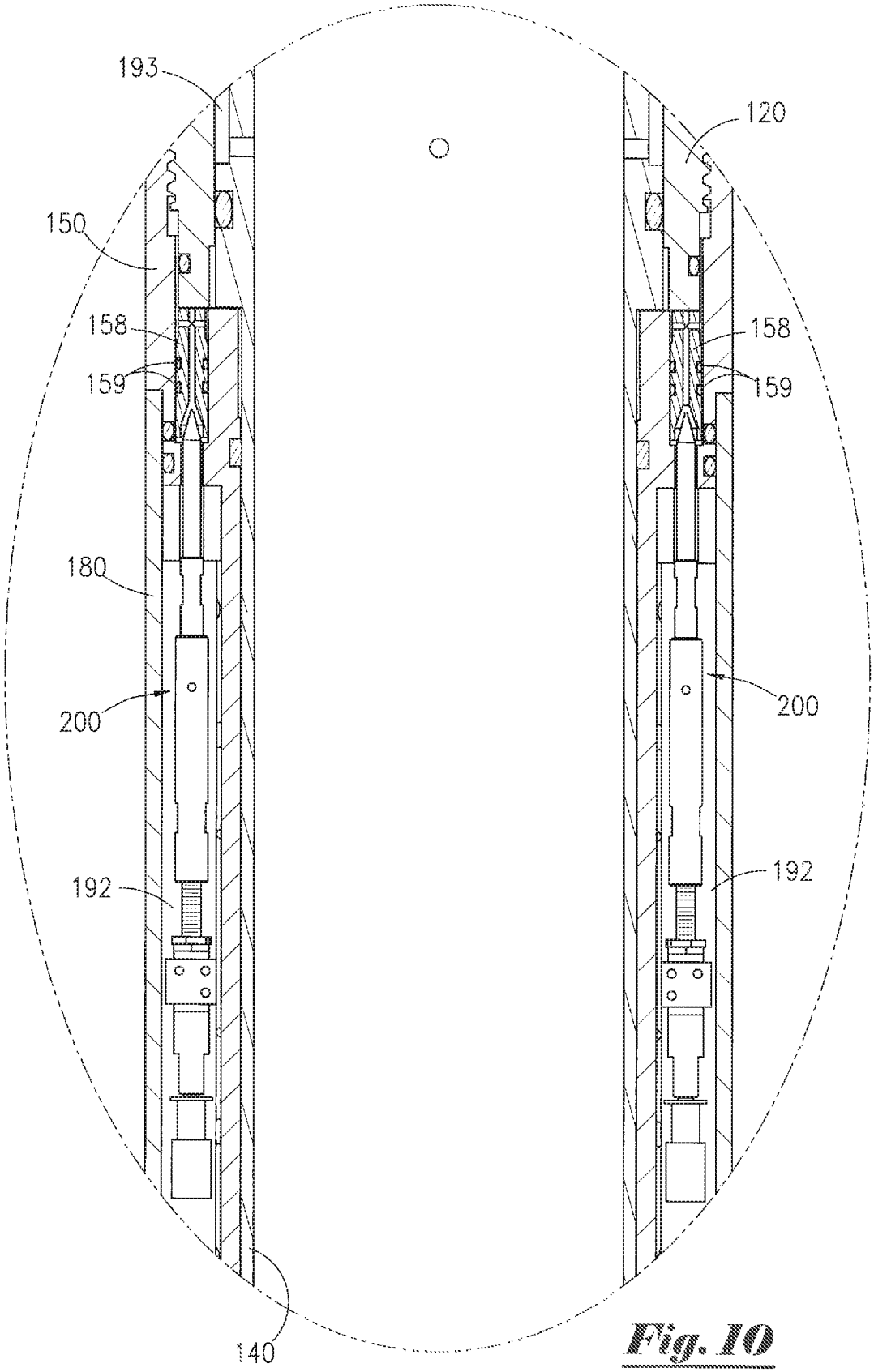
FIG. 10 depicts a detailed view of the area highlighted in FIG. 8B.

FIG. 8A depicts a side sectional view of a valve sub-assembly 20 of an equalization assembly 100 of the present invention in an open position, while FIG. 8B depicts a side sectional view of an actuation sub-assembly 10 of an equalization assembly 100 of the present invention in an open position. FIG. 10 depicts a detailed view of the area highlighted in FIG. 8B, generally corresponding to actuation sub-assembly 10.

In the "closed" configuration depicted in FIG. 7A, sleeve member 140 obstructs equalization ports 21. As such, in said closed position, sleeve member 140 isolates fluid pressure and flow through said equalization ports 21.

Referring to FIG. 7A, valve body member 120 has a central through-bore defining inner surface 129. Sleeve member 140 is slidably disposed within said central through-bore of said valve body member 120. Flapper 126 is hingedly connected to said valve body member 120 using flapper hinge pin 127. As depicted in FIG. 7A, flapper 126 is maintained in an "open" or retracted position by sleeve member 140.

In operation, a desired number of equalization assemblies 100 are conveyed on a tubular string and deployed in place within a wellbore, as depicted in FIG. 1. Thereafter, referring to FIG. 8B, an actuation control device 90 can be introduced into the inner through-bore of said tubular string, typically at the earth's surface. Said actuation control device 90 can comprise a pump-able dart, ball, canister, or container, and can be conveyed into said well by fluid flow or mechanically via coil tubing, jointed tubing or wire line. Said actuation control device 90 can include at least one encased or partially encased magnet, or other apparatus capable of generating a magnetic field.

The specific configuration of actuation control device 90 can vary without departing from the scope of the present invention. For example, actuation control device 90 can comprise: a composite spherical ball of specific outer diameter (OD) with a spherical magnet of specific OD inside; a biodegradable ball of specific OD with a spherical magnet of specific OD inside; a composite ball of specific OD with a cylindrical magnet inside; a biodegradable ball of specific OD with a cylindrical magnet inside; a cement wiper plug with a cylindrical magnet inside; metal plugs with magnetic elements embedded therein, of various shapes, that are pushed down hole by mechanical means; a perforated nitrile rubber ball with a magnet inside or magnetic core; a ball containing a magnet with non-dissolvable composite coating; a ball containing a magnet with a dissolvable composite coating; and/or a rubber wiper plug with a magnetic core.

Each deployed equalization assembly 100 is preset to predetermined counter number. If deployed as a series wherein each equalization assembly 100 will operate separately, then each such assembly will be preset to respond to its own unique counter number. Conversely, if deployed as a group wherein two or more equalization assemblies 100 will actuate substantially simultaneously, then each equalization assembly in said group can be preset to respond to a predetermined shared counter number.

Figure 11:
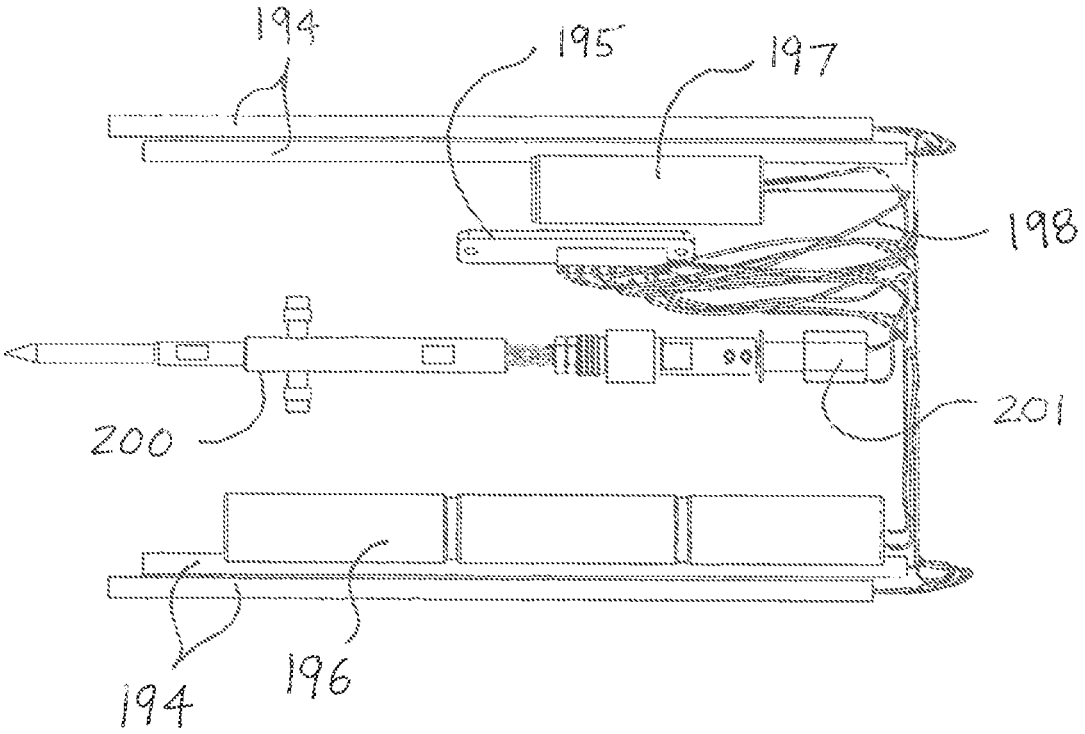
FIG. 11 depicts a side view of certain isolated actuation and electronic components of the equalization assembly of the present invention.
Figure 12:
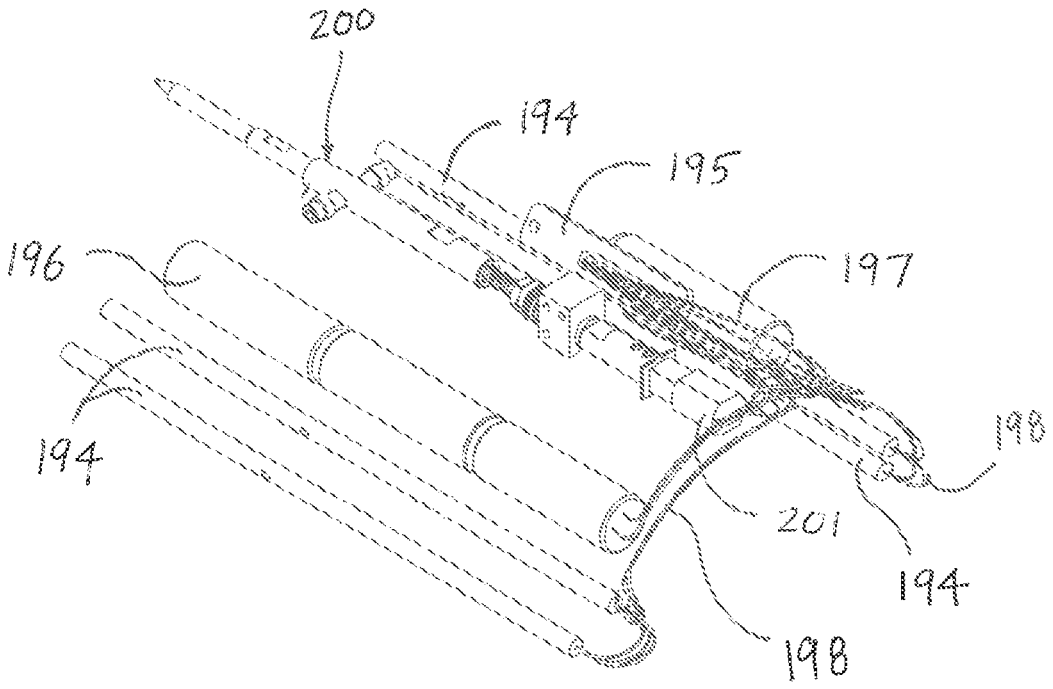
FIG. 12 depicts a perspective view of certain isolated actuation and electronic components of the equalization assembly of the present invention.

FIG. 11 depicts a side view of certain isolated actuation and electronic components of the equalization assembly of the present invention, while FIG. 12 depicts a perspective view of certain isolated actuation and electronic components of the equalization assembly of the present invention. Such components are depicted in FIGS. 11 and 12 separate and apart from other components of the equalization assembly of the present invention for illustration and clarity purposes. Referring to FIGS. 11 and 12, reed switch(es) 194 each comprise a bulb that is adapted to sense a magnetic field, electronically connected to micro controller board 195, such as via wires 198. Said micro controller board 195 is further electronically connected to batteries 196 and 197 and micro motor 201 of linear actuation assembly 200 using wires 198. By way of illustration, but not limitation, micro controller board 195 generally provides circuitry necessary for one or more control task operations including, without limitation, microprocessor, counter(s) for registering count events, input/output circuits, clock generator, RAM, data storage memory, stored program memory and support integrated circuits.

Figure 13:
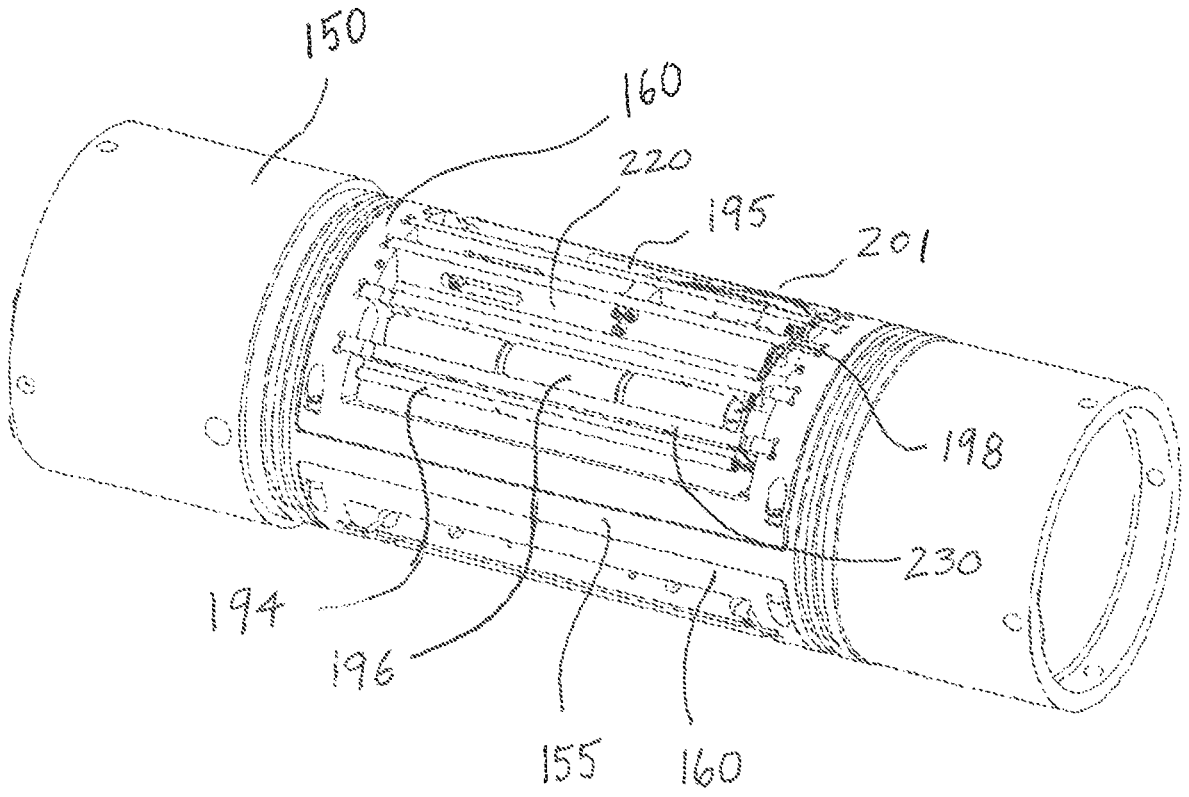
FIG. 13 depicts a perspective view of certain actuation and electronic components installed within the equalization assembly of the present invention.
Figure 14:
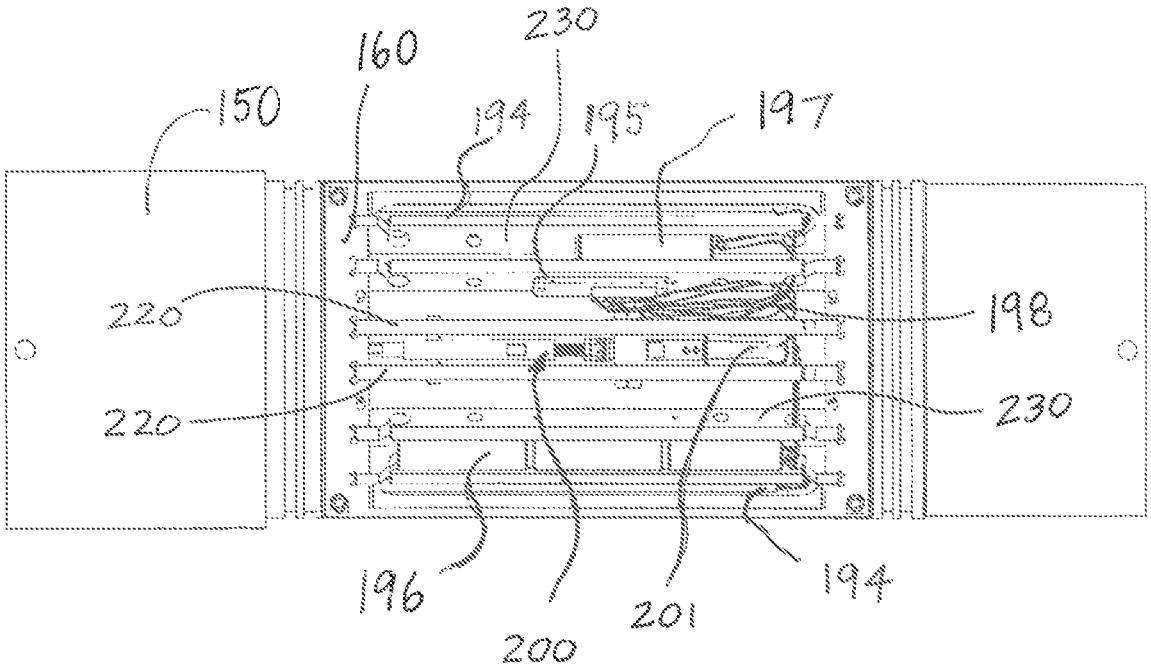
FIG. 14 depicts a side view of certain actuation and electronic components installed within the equalization assembly of the present invention.

FIG. 13 depicts a perspective view of certain actuation and electronic components installed within the equalization assembly of the present invention, while FIG. 14 depicts a side view of certain actuation and electronic components installed within said equalization assembly. Referring to FIGS. 13 and 14, reed switches 194 are electronically connected to micro controller board 195 using wires 198. Said micro controller board is further electronically connected to batteries 196 and 197 (which can comprise a plurality of batteries forming separate packs) and micro motor 201 of linear actuation assembly 200 using wires 198. As depicted in FIGS. 13 and 14, said components can be installed within retention cage members 160 and mounted using actuator support braces 220 and sleeve support members 230. Said retention cage members 160 are, in turn, secured in place and operationally attached to lateral wing flange members 155 as described above.

Referring to FIG. 8B, as actuation control device 90 passes through equalization assembly 100, a magnetic field created by said actuation control device 90 is sensed by at least one reed switch 194. Said reed switches 194 each comprise a normally open component comprising a bulb that senses a magnetic field. When said magnetic field from actuation control device 90 is sensed, the reed switch 194 is closed and this closure signal is sent to a micro controller board 195 as a count. Alternately, said reed switch 194 may close and remain closed due to residual magnetism. In this event, when said magnetic field from actuation control device 90 is sensed said reed switch will go through an open/close/open sequence.

Said micro controller board senses by a change of state of said reed switch, being open to closed, or close to opened. When a desired number of magnetic fields is sensed by reed switch 194, said micro controller board, powered by battery pack 197, closes an electronic switch to allow current to flow from a battery pack 196 to micro motor 201 of linear actuation assembly 200. In a preferred embodiment, said battery pack(s) 196 and 197 comprises at least one high heat-resistant lithium battery.

Each reed switch assembly 194 has a forward and reverse sensor. The forward sensor tracks the number of magnetic fields that pass across it for the count, while the reverse sensor will track magnetic fields coming from an opposite direction or in a flow back situation. When and if a magnetic field is sensed coming from the opposite direction (that is, for the opposite direction than actuation control device is launched), the micro controller board 195 will detect direction and not accept the situation as a valid count. In a preferred embodiment, each equalization assembly 100 will have a plurality of reed switches 194 grouped into sets (wherein each set beneficially comprises four (4) reed switch assemblies positioned approximately 90 degrees apart).

Micro controller board 195 controls the activation linear actuator assembly (200) to the open needle valve assembly. The sequence or specific count can be pre-programmed into said micro controller board 195 using a special programmable hand held device, or via wireless means (transmitter and receiver). In a preferred embodiment, said count is a numeric value—for example, said count can start with a count of 1 and goes up to a larger number. Each equalization assembly can have a specific and predetermined count number assigned to it.

In the event that actuation control device 90 passes through an equalization assembly 100 that is preset to actuate when a particular counter number is reached, and that predetermined counter number is achieved, then that specific equalization assembly 100 will actuate.

When micro-motor 201 is in the forward or left turn direction, linear actuator assembly 200 forces tapered section 242 of needle valve shaft 240 into needle valve seat insert 158. When such contact is made, linear actuator assembly 200 compresses said valve shaft 240 against valve seat insert 158 thereby forming a metal-to-metal fluid pressure seal until micro motor 201 is signaled to rotate to the right and release linear actuator from its compressive state. When engaged, this seal holds a fluid of certain pressure in a first chamber 191 depicted in FIG. 7B, and does not allow such fluid to flow into a second chamber 192 of lower pressure (unless and until said valve is opened). When said valve assembly is opened, needle point 243 moves away from seat insert 158, thus opening needle valve assembly.

While said valve assembly is closed, incompressible fluid is trapped within chamber 191, and prevents sleeve 140 from shifting or otherwise moving. However, after said valve assembly is opened and a fluid flow path through said valve assembly is formed, incompressible fluid contained within chamber 191 can evacuate chamber 191 and flow into chamber 192 (which is maintained at a lower fluid pressure). With said incompressible fluid no longer trapped within chamber 191, elevated wellbore fluid pressure acts on area 193 depicted in FIG. 7A and is able to shift sliding sleeve 140. Moreover, incompressible fluid contained within chamber 192 is prevented from flowing in the reverse direction which, in turn, prevents sliding sleeve 140 from moving in a reverse direction due to such higher pressure acting on area 193 of sliding sleeve 140. Also in the event sliding sleeve moves in the reverse direction, lock ring 186 will not allow it to close off equalization ports 21.

After sleeve 140 has shifted as depicted in FIGS. 8A & 8B, equalization ports 21 are exposed and in fluid communication with the internal through-bore of tubular string 310. Further, with said sleeve 140 shifted, flapper 126 is permitted to pivot about hinge pin 127 to move into a closed position. With said flapper 126 in a closed position, fluid pumped from the earth's surface through the inner through-bore of tubular string 310 is prevented from flowing past closed flapper 126 and is redirected out exposed equalization ports 21. Although said valve mechanism is depicted as flapper 126, it is to be observed that other valve configurations including, without limitation, flapper valves, gate valves or sliding valves, can also be used for this purpose. Moreover, in an alternative embodiment, flapper 126 can be removed; after sliding sleeve 140 has shifted, equalization ports 21 are exposed, but a fluid flow pathway also exists through the central through-bore of equalization assembly 100.

In a preferred embodiment, no physical contact or mechanical interference is required between actuation control device 90 and any other components of equalization assembly 100 including, without limitation, sleeve member 140, in order to actuate equalization assembly 100 and shift sleeve member 140 to expose transverse flow ports 21.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for selectively shifting a moveable sleeve of a downhole tool comprising:

a) a housing member having a central through-bore;

b) a sliding sleeve operationally attached to said housing member configured to shift between a first position and a second position;

c) at least one actuation control device adapted to pass through said through-bore of said housing member;

d) a sensor for sensing passage of said actuation control device, wherein said sensor comprises a reed switch;

e) a counter for registering a count when an actuation control device passes said sensor; and f) a motor adapted to shift said sleeve from said first position to said second position when said counter registers a predetermined number of counts.

2. The apparatus of claim 1, further comprising a flapper hingedly connected to said housing member, wherein said flapper is retracted from said through-bore when said sleeve is in said first position, and blocks said through-bore when said sleeve is in said second position.

3. The apparatus of claim 1, wherein physical contact between said at least one actuation control device and any other component of said apparatus is not required in order to shift said sleeve from said first to said second position.

4. The apparatus of claim 1, wherein said actuation control device comprises a composite spherical ball containing a magnet, a biodegradable ball containing a magnet, a cement wiper plug containing a magnet, a perforated nitrile rubber ball containing a magnet, or a metal plug with a least one magnet embedded therein and adapted to be pushed through said through-bore of said housing member.

5. A method for selectively shifting a moveable sleeve of a downhole tool comprising:

a) deploying at least downhole tool in a wellbore, said downhole tool comprising:

i) a housing member having a central through-bore;
ii) a sliding sleeve operationally attached to said housing member configured to shift between a first position and a second position;
iii) at least one actuation control device adapted to pass through said through-bore of said housing member, wherein said at least one actuation control device generates a magnetic field;
iv) a sensor for sensing passage of said actuation control device;
v) a counter for registering a count when an actuation control device passes said sensor;
vi) a motor adapted to shift said sleeve;
vii) a first fluid chamber;
viii) a second fluid chamber; and
ix) a needle valve assembly having an open position and a closed position, said valve assembly disposed between said first and second fluid chambers;

b) passing at least one actuation control device through said through-bore of said housing member; and
c) shifting said sleeve from said first position to said second position when said counter registers a predetermined number of counts.

6. The method of claim 5, wherein said needle valve assembly forms a barrier for containing incompressible fluid in said first fluid chamber when said valve assembly is in a closed position, and said incompressible fluid prevents said sleeve from moving from said first position to said second position.

7. The method of claim 6, wherein said incompressible fluid displaces from said first fluid chamber to said second fluid chamber when said needle valve assembly is in an open position, thereby allowing said sleeve to move from said first position to said second position.

8. The method of claim 5, wherein physical contact between said at least one actuation control device and any other component of said downhole tool is not required in order to shift said sleeve from said first to said second position.

9. The method of claim 5, wherein said actuation control device comprises a composite spherical ball containing a magnet, a biodegradable ball containing a magnet, a cement wiper plug containing a magnet, a perforated nitrile rubber ball containing a magnet, or a metal plug with at least one magnet embedded therein and adapted to be pushed through said through-bore of said housing member.

10. The method of claim 5, further comprising a flapper hingedly connected to said housing member, wherein said flapper is disposed between said housing member and said sleeve when said sleeve is in said first position, and blocks said through-bore when said sleeve is in said second position.

11. An apparatus for selectively shifting a moveable member of a downhole tool comprising:

a) a housing member having a central through-bore, said housing member further comprising:
i) a first fluid chamber;
ii) a second fluid chamber; and
iii) a needle valve assembly having an open position and a closed position, said needle valve assembly disposed between said first and second fluid chambers;

b) a moveable member operationally attached to said housing member configured to shift between a first position and a second position;
c) at least one actuation control device adapted to pass through said through-bore of said housing member, wherein said at least one actuation control device generates a magnetic field;
d) a sensor for sensing passage of said actuation control device;
e) a counter for registering a count when an actuation control device passes said sensor; and
f) a motor adapted to shift said moveable member from said first position to said second position when said counter registers a predetermined number of counts.

12. The apparatus of claim 11, wherein said needle valve assembly forms a barrier for containing incompressible fluid in said first fluid chamber when said valve assembly is in a closed position, and said incompressible fluid prevents said moveable member from moving from said first position to said second position.

13. The apparatus of claim 12, wherein said incompressible fluid displaces from said first fluid chamber to said second fluid chamber when said needle valve assembly is in an open position, thereby allowing said moveable member to move from said first position to said second position.

14. The apparatus of claim 11, further comprising a flapper hingedly connected to said housing member, wherein said flapper is disposed between said housing member and said moveable member when said moveable member is in said first position, and blocks said through-bore when said moveable member is in said second position.

* * * * *